US008944843B2

(12) United States Patent
Keswani

(10) Patent No.: US 8,944,843 B2
(45) Date of Patent: Feb. 3, 2015

(54) ELECTRICAL CONNECTOR WITH A PUSH-IN TYPE CONTACT

(71) Applicant: IDEAL Industries, Inc., Sycamore, IL (US)

(72) Inventor: Sushil N. Keswani, Sycamore, IL (US)

(73) Assignee: IDEAL Industries, Inc., Sycamore, IL (US)

( * ) Notice: Subject to any disclaimer, the term of this patent is extended or adjusted under 35 U.S.C. 154(b) by 96 days.

(21) Appl. No.: 13/724,570

(22) Filed: Dec. 21, 2012

(65) Prior Publication Data

US 2013/0237095 A1 Sep. 12, 2013

Related U.S. Application Data

(63) Continuation of application No. 13/416,432, filed on Mar. 9, 2012, now abandoned.

(51) Int. Cl.

| | |
|---|---|
| ***H01R 13/40*** | (2006.01) |
| ***H01R 13/627*** | (2006.01) |
| ***H01R 4/48*** | (2006.01) |

(52) U.S. Cl.

CPC ..... *H01R 13/6271* (2013.01); *H01R 4/4836* (2013.01); *Y10S 439/91* (2013.01)

USPC ..... 439/441; 439/910; 439/488

(58) Field of Classification Search

USPC ..... 439/441, 439, 488, 910

See application file for complete search history.

(56) References Cited

U.S. PATENT DOCUMENTS

| | | | | |
|---|---|---|---|---|
| 5,425,661 | A | 6/1995 | Self, Jr. et al. | |
| 6,712,649 | B2 * | 3/2004 | Matsuda et al. | 439/835 |
| 6,719,581 | B2 * | 4/2004 | Kikuchi | 439/441 |
| 7,410,386 | B2 * | 8/2008 | Fabian et al. | 439/441 |
| 7,507,106 | B2 | 3/2009 | Keswani et al. | |
| 7,618,279 | B1 * | 11/2009 | Osborn et al. | 439/441 |
| 7,976,330 | B2 * | 7/2011 | Lin | 439/353 |
| 8,187,023 | B1 * | 5/2012 | Chen | 439/441 |
| 8,342,891 | B2 * | 1/2013 | Fukushi | 439/752 |
| 8,550,853 | B2 * | 10/2013 | Fukushi | 439/626 |
| 2005/0042912 | A1 | 2/2005 | Drewes et al. | |
| 2008/0020628 | A1 * | 1/2008 | Kikuchi | 439/441 |
| 2010/0093211 | A1 | 4/2010 | Sutter | |

FOREIGN PATENT DOCUMENTS

WO 2008/082531 A2 7/2008

OTHER PUBLICATIONS

ISA/US, Int. Search Report and Written Opinion issued on PCT Appln. No. US2013/029893, received May 29, 2013, 13 pgs.

* cited by examiner

*Primary Examiner* — Gary Paumen

(74) *Attorney, Agent, or Firm* — Greenberg Traurig, LLP

(57) ABSTRACT

An electrical connector includes a housing having outwardly extending sleeves for connection with a corresponding connector. The housing defines an aperture extending through the extending sleeves, and an electrically-conductive contact is retained within the interior space of the housing and extending into the aperture. The electrically-conductive contact has an end comprising a contact portion within the aperture and an opposite end comprising a push-in type contact element. A cap retains the contact within the interior space, enclosing the interior space, and defining a port to allow insertion of a conductor of various construction therethrough.

15 Claims, 9 Drawing Sheets

ELECTRICAL CONNECTOR WITH A PUSH-IN TYPE CONTACT

FIELD OF THE DISCLOSURE

The present disclosure relates generally to electrical connectors and more particularly, to an electrical connector with a push-in type contact.

BACKGROUND OF RELATED ART

The present disclosure is directed towards a connector for an electrical circuit and more particularly to an electrical connector for a DC power supply. In general, the disclosed example connector provide a convenient and safe way to quickly connect, replace, and/or wire circuit elements together. In one known connector described in U.S. Pat. No. 5,425,661, a single piece molded connector housing is provided with a plurality of receiving bores each having an entry segment of a given diameter leading to a contact bearing of a lesser diameter and a forward segment of a larger diameter than the diameter of the bearing segment. Each of the bores includes a shoulder or step extending radially between the contact bearing segment and the forward segment defining a surface receiving the end of one or more lances formed in an electrical contact that preclude contact backout when fully inserted.

The connector described, however, typically requires a complicated molding process to create the thickness of the housing with the required flexibility and a complicated boring process to create the through holes. Additionally, the conductors described require sophisticated manufacturing techniques complicating the assembly process. Furthermore, the described conductors are cylindrical in shape, thereby limiting the size of wire that the conductor can accept. Still further, the connector does not include any external visual indication that the conductors are properly seated behind the step, thus the conductors may be subject to backout over time and/or when removing the wire.

Accordingly, there is an identifiable need for a connector that is adapted for use with a DC power supply including a universal pin-type DC power supply such as a universal MATE-N-LOK connector available from Tyco Electronics. The disclosed example connector provides for a different manufacturing technique, a push-in type contact for acceptance of multiple conductor sizes, and/or a connector that provides an indication that the contact is properly seated within the housing. The present disclosure provides one such connector.

DETAILED DESCRIPTION

The following description of example electrical connectors is not intended to limit the scope of the description to the precise forms detailed herein. Instead the following description is intended to be illustrative so that others may follow its teachings.

Referring now to the figures, an example electrical connector 10 is generally shown. The example electrical connector 10 shows a push-in type contact having a 2-pole design for connecting two sets of conductors, such as wires to a corresponding receiving connector, not shown. It will be appreciated by one of ordinary skill in the art that the connector 10 could be designed for use with any number of poles and/or combinations of poles as desired.

Figure 1:
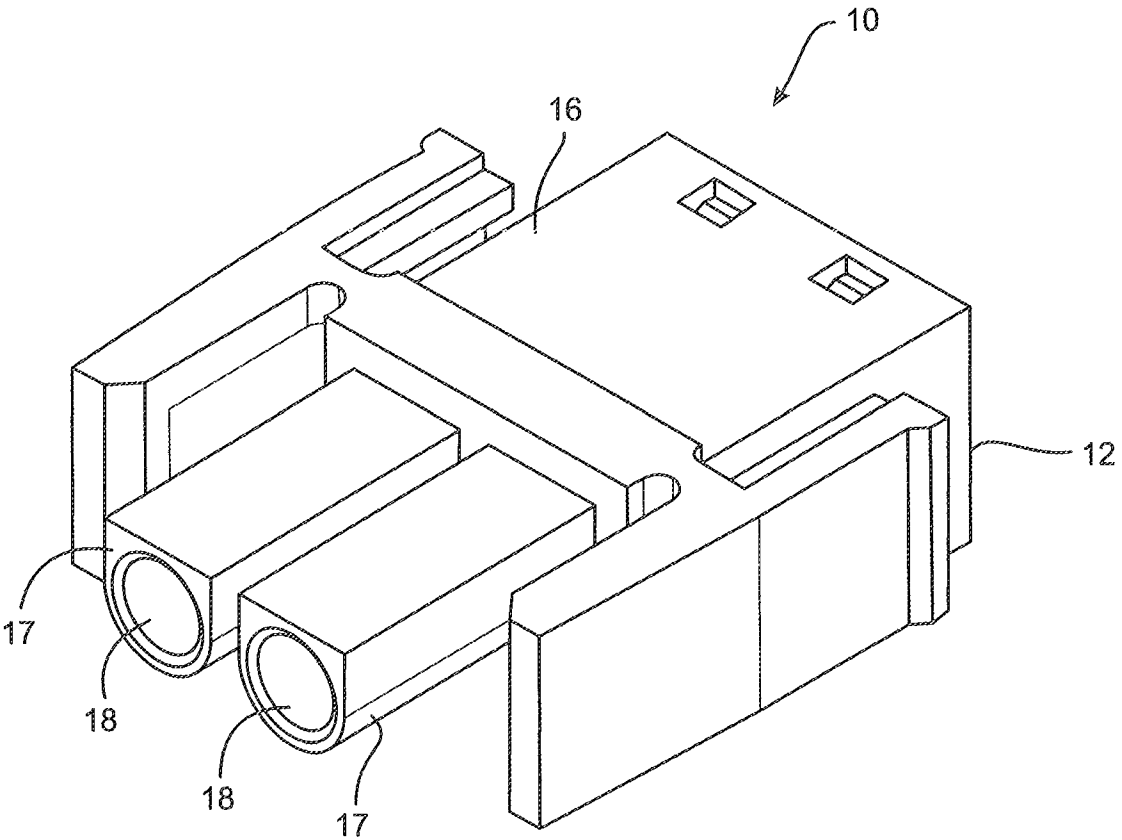
FIG. 1 is a front perspective view of an example connector of the present disclosure.
Figure 2A:
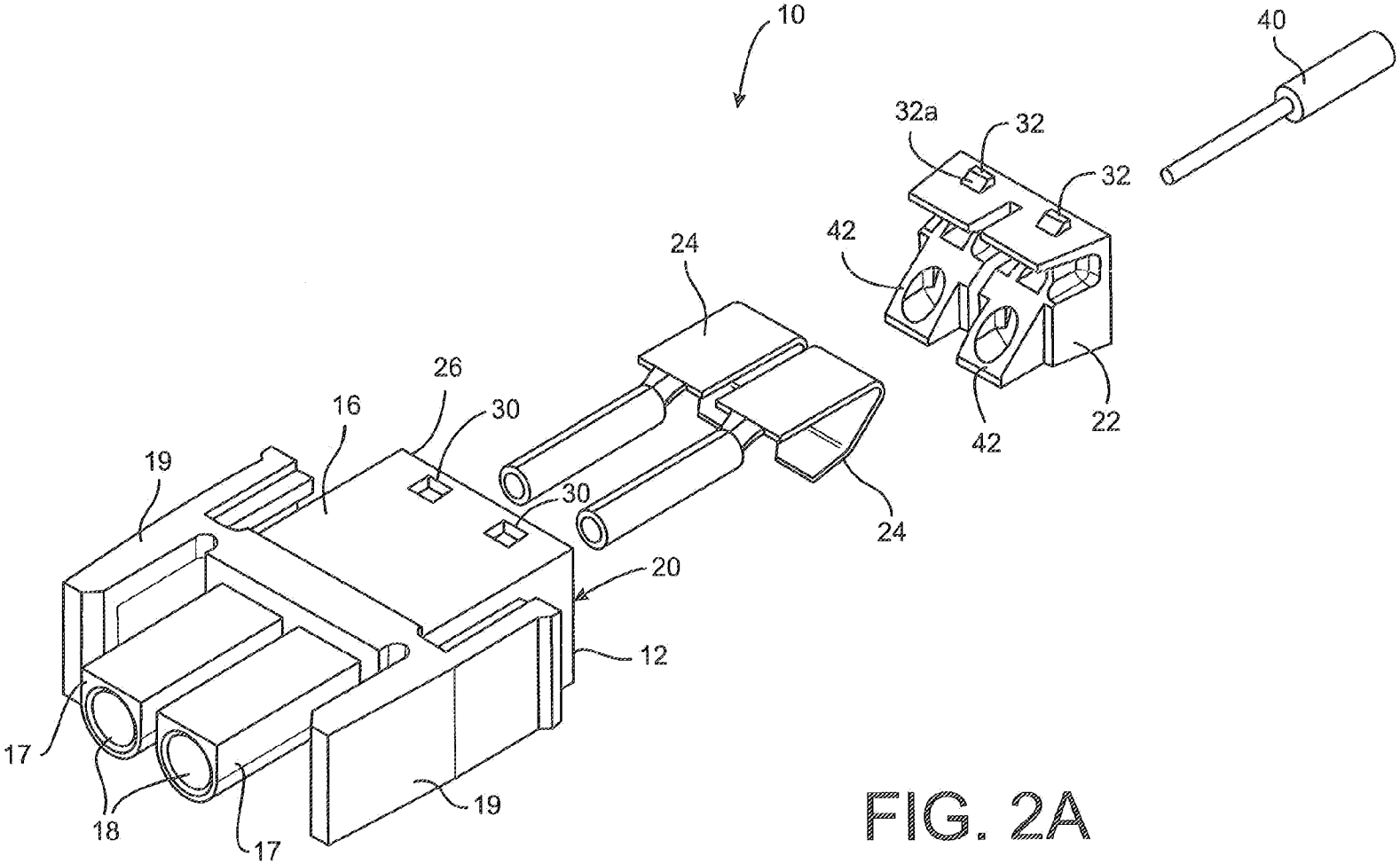
FIG. 2A is an exploded front perspective view of the example connector of FIG. 1.
Figure 2B:
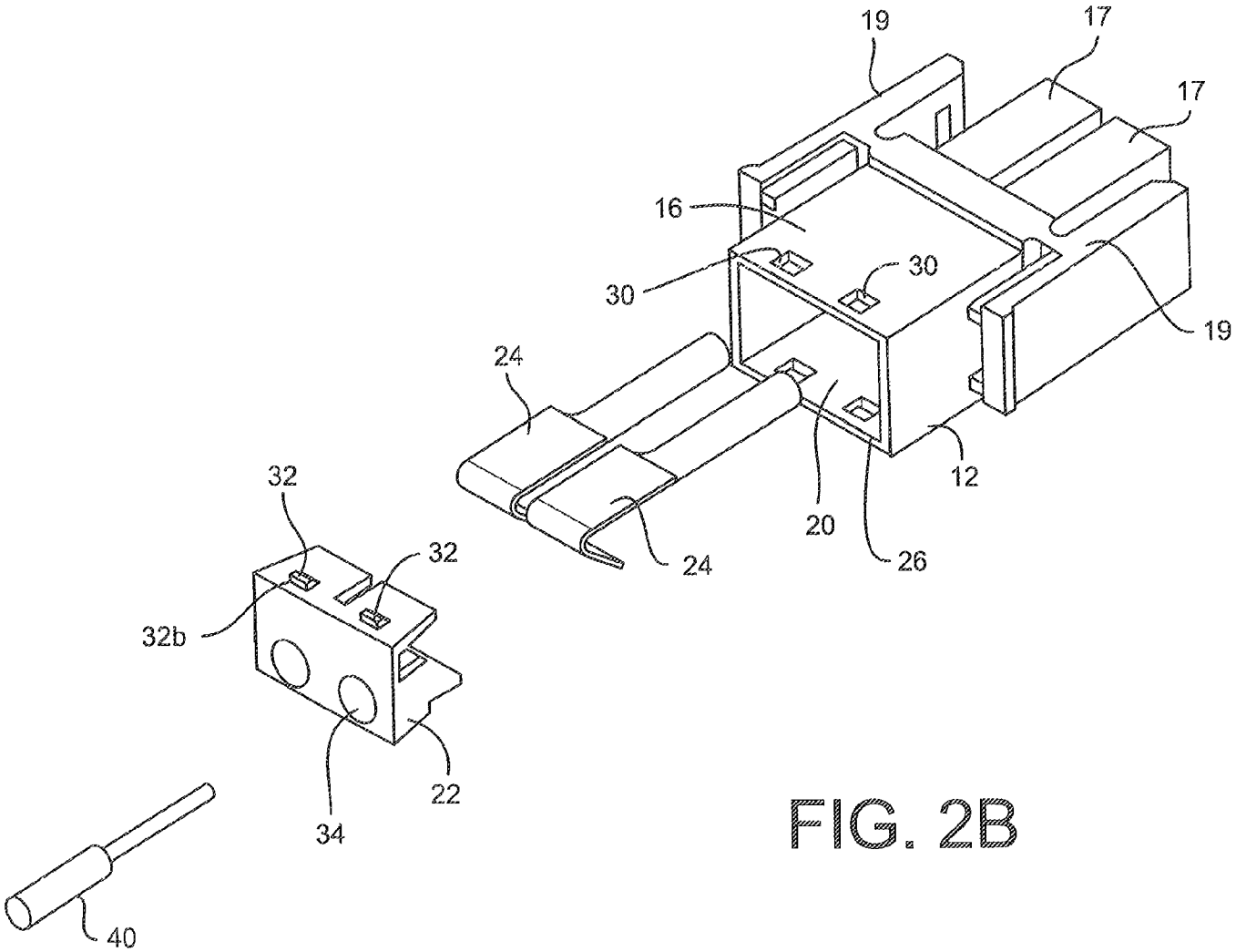
FIG. 2B is an exploded rear perspective view of the example connector of FIG. 1.
Figure 3:
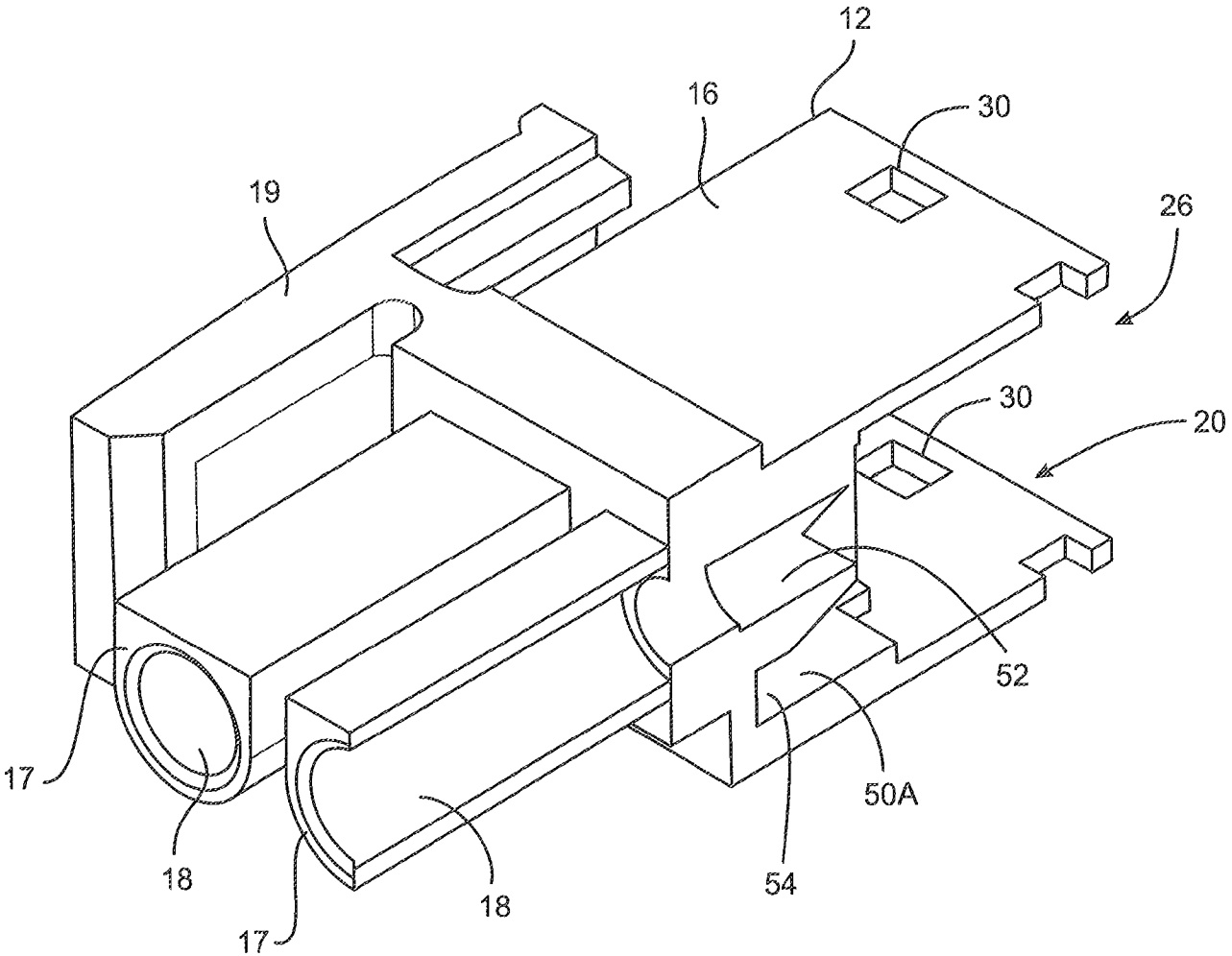
FIG. 3 is cross-section front perspective view of the housing of the example connector of FIG. 1.

Referring in particular to FIGS. 1-3, the example connector 10 includes a housing 12 having a wire connect portion 16 that defines, in this example, an interior space 20, and a pair of outwardly extending sleeves 17 defining a pair of apertures 18 extending along an axis of insertion of the connector 10 and a corresponding mating connector (not shown), such as a DC power supply. In one example, the corresponding mating connector is a universal MATE-N-LOK connector available from Tyco Electronics. As can be seen in the cross section of FIG. 3, the apertures 18 defined by the sleeves 16 are open to and join the interior space 20 of the wire connect portion 16. The example housing 12 further includes a pair of hinged exterior tabs 19 allowing the exterior portion of the housing to flex for latching and/or engaging purposes.

Returning to FIGS. 2A and 2B, which each show an exploded view of the example connector 10, the connector 10 also includes a push-in cap 22. Together, the housing 12 and the cap 22 enclose two contacts 24 mounted in the apertures 18 and the interior space 20. In addition to the interior space 20, the wire connect portion 16 defines an open end 26 to receive the cap 22. Regarding the wire connect portion 16, the housing 12 defines at least one aperture 30 proximate to the open end 26 of the interior space 20. The aperture 30 is adapted to engage a corresponding hook 32 which protrudes from the caps 22 to retain the cap 22 in the housing 12. Additionally, the example cap 22 has a plurality of ports 34 extending through the cap 22. These ports 34 provide access to the interior space 20 of the wire connect portion 16 to allow a conductor, such as a wire 40 to contact the retained contacts 24.

Still further, in the illustrated example, each of the hooks 32 includes a cammed surface 32*a* and a stepped surface 32*b* to securely engage the aperture 30 in a snap-fit arrangement. As will be appreciated by one of ordinary skill in the art, in the example shown, the proper seating of each of the hooks 32 in the proper aperture 30 will provide an externally visible confirmation of the proper seating of the cap 22 within the housing 12. For instance, if the cap 22 is not properly seated, the cammed surface 32*a* will force the housing defining the opening 26 outwards from the cap 22, providing a visual and physical indication that the cap 22 is improperly seated in the housing 12. In still other examples, the hook 32 may be provided with a color indicator and/or other visual marker to identify when the cap 22 is properly retained in the aperture 30.

In at least one example, the housing 12 and the cap 22 are formed of a non-conductive material such as, for example, a thermoplastic material. As noted above, the housing 12 and/or the cap 22 may be formed of a flexible material to allow the deflection of the exterior tabs 19 and the insertion of the cap 22 into the housing 12. It will be appreciated by one of ordinary skill in the art, however, that the material used to form the housing 12 and the cap 22 need not be the same material, and furthermore, may be any suitable material including thermoplastics, thermosets, ceramics, conductive and non-conductive materials alike.

Figure 4:
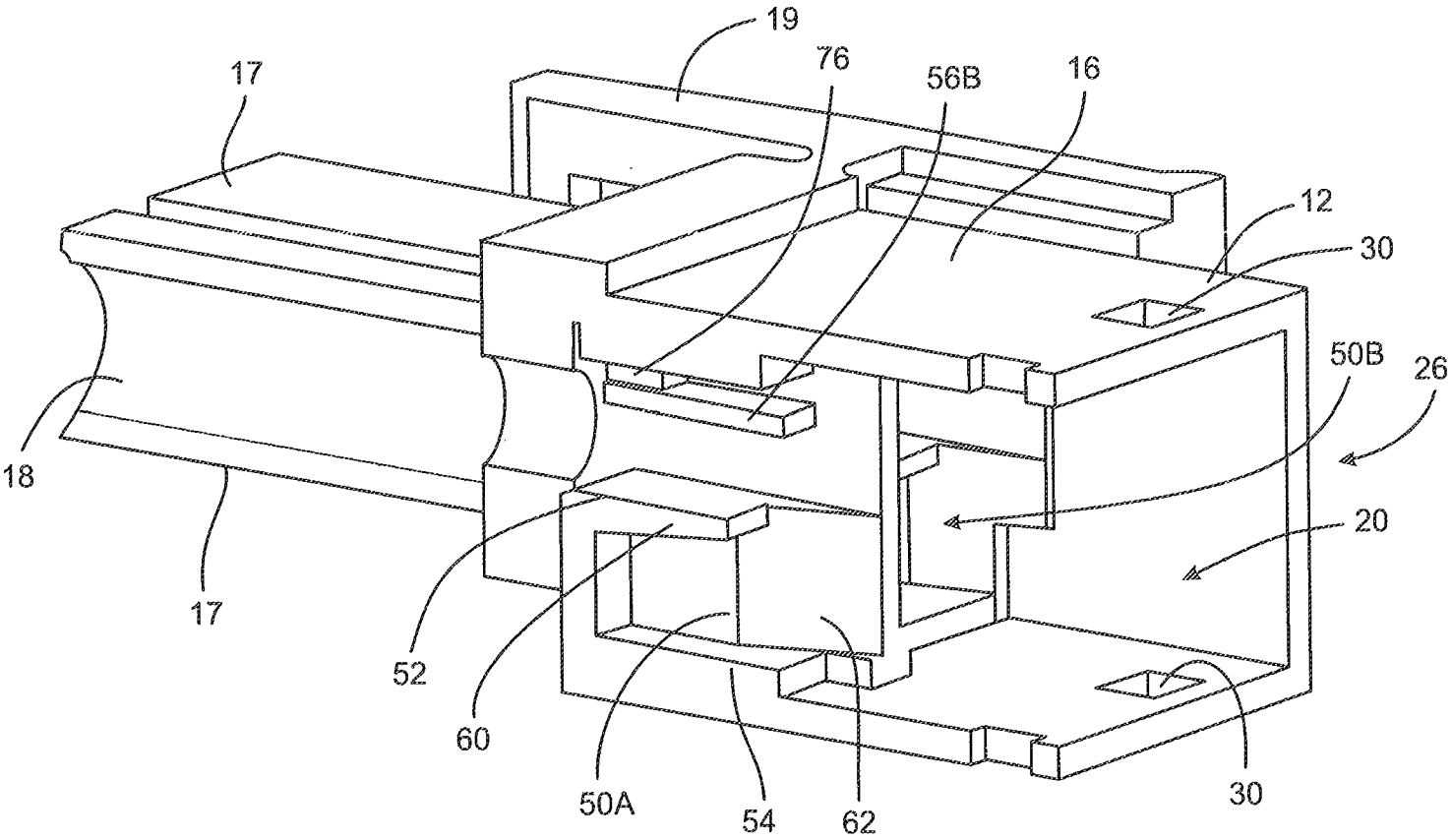
FIG. 4 is cross-section rear perspective view of the housing of the example connector of FIG. 1.
Figure 5:
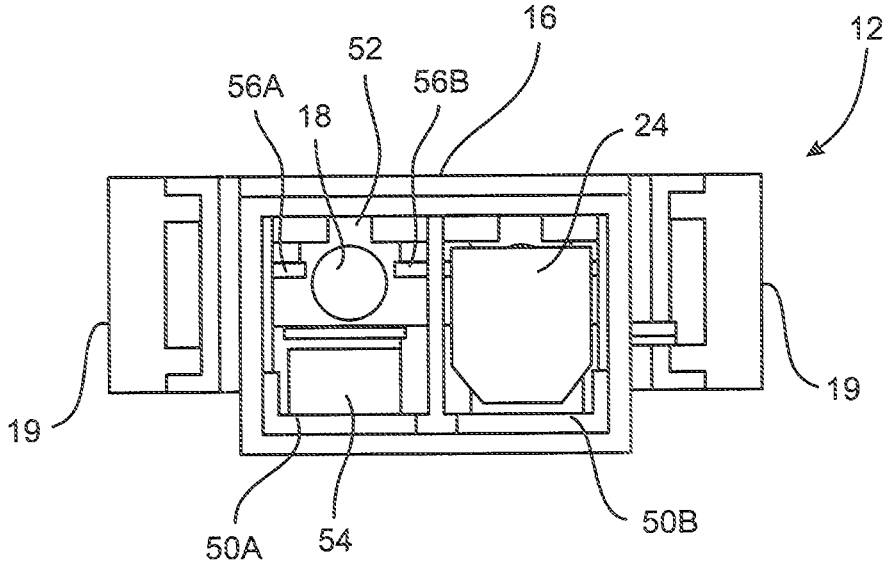
FIG. 5 is a rear elevational view of the example housing of FIG. 1 a single contact inserted therein.

FIGS. 3-5 illustrate the interior features of the wire contact portion 16 of the housing 12. In the illustrated example of FIGS. 3 and 4, both the contacts 24 and the cap 22 typically located within the housing 12 have been removed for ease of illustration, while in FIG. 5, the cap 22 and only one of the contacts 24 has been removed. In this example, the wire contact portion 16 generally defines two compartments 50A and 50B. Each of the compartments 50A, 50B includes an upper portion 52 and a lower portion 54 such as a wire receiving compartment. The upper portion 52 is adapted to accept a contact portion of the contact 24 as described in detail below. The lower portion 54 is generally a four-sided compartment sized to accept the wire 40, such as an 18 awg solid wire, inserted through ports 34 such as apertures 42 formed in the cap 22. It will be understood by one of ordinary skill in the art that the apertures 42 and the compartments 50A, 50B may be sized to accept any size and/or type of suitable contact and/or wire such as larger/smaller contacts and wires of larger and/or smaller gauge as well as stranded and/or solid wires. As illustrated the walls of at least one of the compartments 50A, 50B may be tapered in cross section from the opening 26 to the middle of the housing to pinch and/or otherwise constrict the wire 40 when inserted into the compartment 50A, 50B.

The upper portion 52 of each compartment 50A, 50B includes a pair of support rails 56A, 56B. The support rails 56A, 56B engage lateral edges of a support surface of the contacts 24. A spring shoulder 76 provides a flat surface for the contacts to rest and can also be used to indicate that the contact 22 has been inserted to the proper depth. As previously noted, the interior of the housing 12 is open to and joins to the interior apertures 18 of the extending sleeves 17.

The lower portion 54 of each compartment is generally an enclosed structure having outer walls. An upper spring stop 60 extends between the upper portion 52 and the lower portion 54. The spring stop 60 prevents over-deflection of the blade portion of the contact 24 and cooperates with inwardly convergent sloping surfaces, such as a guide wall 62 to direct incoming conductors into a seat defined by the outer walls and the guide walls. In operation, the lower portion 54 constrains the wire 40 to a confined area which may be of particular importance for some conductors, such as for example, with stranded wire conductors because the confined seats prevent the conductors from flattening out or splaying, which if it occurred could cause a reduction in the holding force of the push-in type contact elements 24. As noted, the spring stop 60 may also limit deflection of the spring finger of the contact elements 24. With the larger wire sizes it may be possible to cause plastic deformation of the spring fingers during insertion of the wire, and thus the spring stop 60 is disposed in the path of spring finger movement to limit flexure of the spring finger to an amount no more than their elastic limit.

Figure 6:
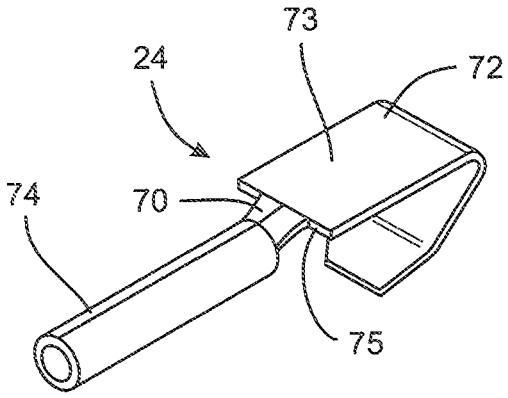
FIG. 6 is a perspective view of an example contact of the example connector.
Figure 7:
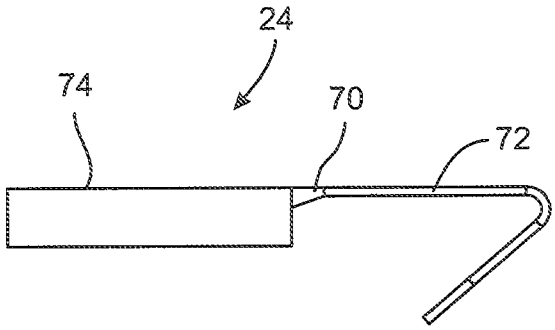
FIG. 7 is a side elevational view of the example contact of FIG. 6.
Figure 8:
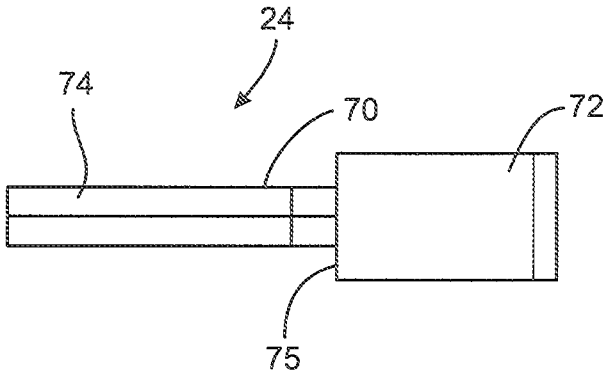
FIG. 8 is a top plan view of the example contact of FIG. 6.

FIGS. 6-8 illustrate details of the example contact 24. As illustrated, each example contact 24 is made of a suitable, electrically conductive material, such as for example, a 510, 511, or 519 phosphorous bronze, brass, spring temper. The contact 24 defines a central plate 70 having a resilient contact 72 at one end and a contact portion 74 at the other end. The resilient contact 72 may be any suitable connector including, for example, a spring finger folded back on the central plate 70 at any suitable angle as desired. The spring finger serves as a push-in contact element that mechanically and electrically engages the wire 40 pushed into the housing 16 and includes a support surface 73 having lateral edges. A contact stop 75 ensures the contact 22 is inserted in the correct position by contacting the spring shoulder 76.

At an end opposite to the spring finger 72, there is the contact portion 74. In this example, the contact portion 74 is suitably sized and shaped to electrically engage an electrical contact in the corresponding receiving connector. Accordingly, because in this instance the contact portion is designed to matingly engage a post-type contact in a corresponding connector, the contact portion 74 defines a mating surface having a generally cylindrical shape. Thus, it will be appreciated by one of ordinary skill in the art that in the instance where the corresponding receiving connector includes a different type of contact, the shape and/or size of the contact portion 74 will vary.

Having described the individual components of the connector 10, attention can now be focused on FIGS. 2A and 2B, which illustrate assembly of the connector 10 as follows. In this example, the contacts 24 are pushed into the housing 12 and into the wire receiving compartments 50A and 50B through the open end 26 of the housing 12. The first contact 24 is arranged so that the lateral edges of its support surface 73 are adjacent to and supported by the support rails 56A, 56B. The contacts 24 are retained within the housing 12 by the cap 22 as described above. The recess defined by the lower portion 54 affords some space in which the resilient contact 72 may flex with insertion of the wire 40. Once the contacts 24 are inserted, the connector 10 is ready for use.

The use, operation, and function of the example disconnect 10 are as follows. To use the connector 10, stripped wires 40 are pushed into the housing 22. The stripped wires 40 fit through the apertures 42 formed in the cap 22 and slide under the resilient contact 72 (e.g., the spring fingers) of the contacts 24. As noted above, the resilient contacts 72 flex to receive the wires 40. Because any withdrawal of the wires 40 would tend to make the resilient contact 72 rotate toward the bottom edge of the housing, the contacts 24 are self-locking. Once the wires 40 are thus installed, the connector 10 is ready for use.

It will be appreciated that while the example connector 10 is described as maintaining a single wire in each contact finger it will be appreciated that in some instances, their may be multiple wires retained by at least one finger as desired. For example, in some instances, multiple wires may be inserted into a single finger.

Furthermore, it will be understood that throughout this description, relative designations such as "top", "bottom", "front", "rear", "down", "up", etc, are used herein for reference purposes only, as there is nothing inherent in the orientation of the example disconnects that would make a particular orientation necessary.

Although certain examples have been described herein, the scope of coverage of this patent is not limited thereto. On the contrary, this patent covers all methods, apparatus, and articles of manufacture fairly falling within the scope of the appended claims either literally or under the doctrine of equivalents.

I claim:

1. An electrical connector, comprising:

a non-electrically-conductive housing having an interior space in which is carried at least one flexible, electrically-conductive push-in type contact having a first end configured to receive and grip an electrical conductor and a second end having a contact portion to releasable electrically couple with a contact housed within a corresponding connector releasably mateable with the housing; and a cap for enclosing the interior space and retaining the electrical conductor within the housing;

wherein the contact portion of the push-in type contact is generally cylindrical in shape, the housing has a viewing port, the cap comprises a visible element, and the visible element is arranged on the cap so as to be viewable via the viewing port to indicate when the cap is arranged relative to the housing with the push-in type contact being properly seated in the housing.

2. An electrical connect as defined in claim 1, wherein the housing defines a first interior space enclosing the first end for receiving and gripping the first end of the electrical conductor, and an extending sleeve defining an aperture enclosing the second end of the electrical conductor.

3. An electrical connector as defined in claim 2, wherein the housing further comprises an outwardly extending sleeve, and wherein the contact portion of the push-in type contact extends in the sleeve.

4. An electrical connector as defined in claim 1, wherein the contact housed within a corresponding connector releasably mateable with the housing is a post contact and wherein the contact portion of the push-in type contact is sized to releasably electrically couple with the post contact.

5. An electrical connector as defined in claim 1, wherein the corresponding connector is a DC power supply.

6. An electrical connector comprising:

a non-electrically-conductive housing having at least one outwardly extending sleeve and defining an interior space;

the housing defining at least one aperture extending through the at least one outwardly extending sleeve and joining with the interior space;

an electrically-conductive contact retained within the interior space and extending into the at least one aperture, the electrically-conductive contact having an end comprising a contact portion within the at least one aperture and having an opposite end comprising a push-in type contact element; and a cap retained by the housing and adapted to retain the electrically-conductive contact within the interior space and enclose the interior space, the cap defining a port arranged to allow insertion of a conductor there through such that the conductor mechanically and electrically couples to the push-in type contact element intermediate the push-in type contact element and an interior surface of the housing;

wherein the housing further defines a wire retaining compartment intermediate the interior surface of the housing and the defined at least one aperture in which an end of the inserted conductor is retained when mechanically and electrically coupled to the push-in type contact element.

7. An electrical connector as defined in claim 6, wherein the at least one outwardly extending sleeve is adapted for engagingly mating with a corresponding connector having an electrical contact that extends into electrical engagement with the contact portion of the electrically-conductive contact.

8. An electrical connector as defined in claim 6, wherein the contact portion is cylindrical.

9. An electrical connector as defined in claim 6, wherein the interior surface comprises at least one support rail to engage a lateral edge of the electrically-conductive contact.

10. An electrical connector as defined in claim 6, wherein the housing comprises at least one hinged exterior tab coupled to an exterior of the housing for engaging the connector with a corresponding connector.

11. An electrical connector as defined in claim 6, further comprising a plurality of electrically-conductive contacts retained within the interior space of the housing.

12. An electrical connector as defined in claim 11, wherein each of the plurality of electrically-conductive contacts retained within the interior space of the housing are electrically isolated.

13. An electrical connector as defined in claim 6, wherein the wire retaining compartment includes at least one inwardly convergent sloping surface.

14. An electrical connector as defined in claim 6, wherein the push-in type contact element includes a spring finger.

15. An electrical connector as defined in claim 14, wherein movement of the spring finger is restricted by a stop defined by the housing and protruding within the interior space.

* * * * *